US005651546A

United States Patent [19]

Lawlor et al.

[11] Patent Number: 5,651,546

[45] Date of Patent: Jul. 29, 1997

[54] AMUSEMENT DEVICE REWARD SYSTEM

[75] Inventors: Patrick Lawlor, Marengo; Matthew C. Coriale, Algonquin, both of Ill.

[73] Assignee: Williams Electronics Games, Inc., Chicago, Ill.

[21] Appl. No.: 599,905

[22] Filed: Feb. 14, 1996

[51] Int. Cl.[6] ..... A63F 7/36

[52] U.S. Cl. ..... 273/118 R; 273/118 A; 273/119 R; 273/121 R

[58] Field of Search ..... 273/118, 119, 273/121; 221/268, 270, 199

[56] References Cited

U.S. PATENT DOCUMENTS

| | | | |
|---|---|---|---|
| 1,700,541 | 1/1929 | Mills | 221/199 |
| 2,926,915 | 3/1960 | Johns | 273/118 A |
| 5,137,278 | 8/1992 | Schilling et al. | 273/119 A X |
| 5,149,093 | 9/1992 | Schilling et al. | 273/121 A X |
| 5,292,127 | 3/1994 | Kelly et al. | 273/118 A |
| 5,487,459 | 1/1996 | Farmont | 221/268 X |
| 5,542,569 | 8/1996 | Millar | 221/268 X |
| 5,558,197 | 9/1996 | Rothschild et al. | 194/344 |

*Primary Examiner*—Raleigh W. Chiu
*Attorney, Agent, or Firm*—Rudnick & Wolfe

[57] ABSTRACT

A rolling ball game is provided with a token dispenser which dispenses game tokens by rolling them onto the inclined cover glass of the game cabinet. The dispenser is provided with controls to permit interaction of the dispenser with the game housed within the cabinet. Thus, dispensing may occur during game play as a function of player skill when appropriate events occur on the game playfield. Tokens provide a basis for players to defer game rewards, such as bonus points or special game features until another game.

9 Claims, 4 Drawing Sheets

AMUSEMENT DEVICE REWARD SYSTEM

BACKGROUND

The invention relates to amusement devices, including rolling ball games. More specifically, the invention relates to a device for providing dynamic delivery of tangible game rewards in the form of game tokens for a coin-operated amusement device. The invention also relates to a system for providing deferred game rewards in an amusement device.

As competition in the field of amusement devices increases, so does the effort to enhance the appeal of particular games to the general public and to evoke player interest. Game appeal depends, in part, on the degree of interaction between the game and the player, and on the rewards associated with the successful achievement of game objectives. There is an ongoing effort to increase the interaction between the player and the game and to develop new rewards for skillful game play. This effort is especially pronounced in the pinball or rolling ball game industry. Numerous attempts have been made to provide rolling ball games with new and exciting interactive and rewarding features designed to increase player appeal.

It is known in the art to provide rewards, both intangible and tangible, to game players for skillful play. Intangible game rewards often take the form of bonus plays, additional points, or increased activity on the game playfield. Tangible rewards to the game player may be provided in the form of placards, For example, U.S. Pat. Nos. 5,137,278 and 5,149,093 to Schilling et al. disclose a trading card dispenser for a rolling ball game. Players are rewarded with trading cards for skillful game play and achievement of predetermined game objectives. These reward features, however, provide limited additional game appeal. inasmuch as the action involved in card delivery is rather unexciting. Moreover, rewards such as trading cards, i.e. baseball cards, are not redeemable for rewards provided by the game itself. Hence, such rewards provide only a limited incentive for the player to return to play the game, especially after all of the cards have been collected by that player.

It is therefore an object of the present invention to provide a reward system that is capable of delivering tangible game rewards in an exciting fashion. It is a further object of the invention to provide a reward system that interacts with the amusement device and with the player during game play. It is yet another object of the invention to provide a reward system that provides players with the opportunity to save tangible rewards and to redeem them for game play or special game features at another time. These and other objects will become apparent to those of ordinary skill from the detailed description provided below.

SUMMARY

The present invention provides a novel approach to the delivery of tangible rewards in the form of game tokens. In a preferred embodiment, the tokens are dispensed through a slot in the game cabinet such that the tokens roll down an inclined glass surface of the cabinet towards the game player. The token dispenser is controlled by the game computer such that token delivery corresponds with specific game events, such as the display of video images from a display on the game cabinet, in order to give the impression that the amusement device is interacting in a tangible way with the game player. The present invention also provides a system for permitting game players to benefit from the game rewards. Tokens may be used for replays of the game and may activate special game features that are not otherwise available to players. Tokens may also be used to play a different amusement device.

DETAILED DESCRIPTION OF THE DRAWINGS

Figure 1:
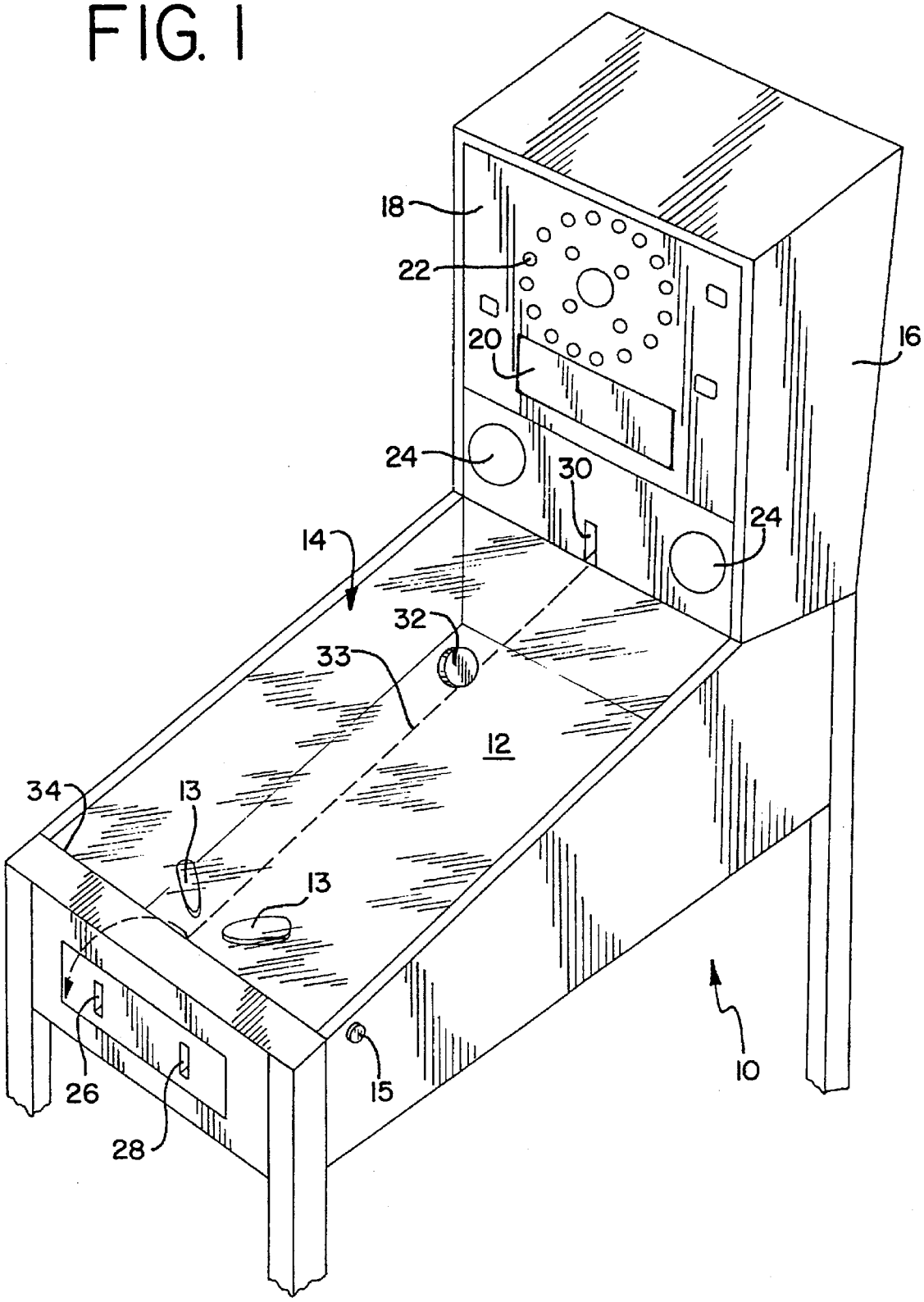
FIG. 1 is a perspective view of a rolling ball game cabinet incorporating a token dispensing apparatus according to the present invention.

Referring to FIG. 1, game cabinet 10 houses inclined playfield 12 which supports a rolling ball thereon. As is known, a number of game features (not shown) are provided on the playfield 12 and interact with the ball as the player controls it to score points. Flippers 13, which are actuated by switch buttons 15 disposed on the game cabinet, are provided for controlling and projecting the game ball as it rolls by gravity towards the front of playfield 12. A glass top 14, which is inclined with respect to the horizontal, permits the player to view the playfield but prevents tampering with the playfield. Back box 16 houses display panel 18 for displaying score and game status indicia to the player on a video display or LED display matrix 20 which may also provide graphical images during the game. A coin input slot 26 and token input slot 28, whose function will be described below, are provided on a front panel 29 of cabinet 10. Speakers 24 are provided for audio effects. Lights 22 are provided for entertainment value and/or may be integrated into the game.

In accordance with a preferred embodiment of the present invention, a token delivery slot 30 is disposed near the bottom of back box 16 at the level of the glass 14. A game token 32, which comprises a disk-shaped metallic element, is projected through delivery slot 30 by a dispensing mechanism which will be described below. Delivery slot 30 is provided near the upper edge of window 14 and dispenses token 32 in an upright manner such that token 32 rolls by force of gravity along travel path 33, indicated by dotted line in FIG. 1. As token 32 rolls downward along window 14, it encounters a ridge 34 which causes rolling token 32 to be projected upwards from the game cabinet in the direction of the player. Tokens are projected when the player achieves selected game objectives.

Figure 2:
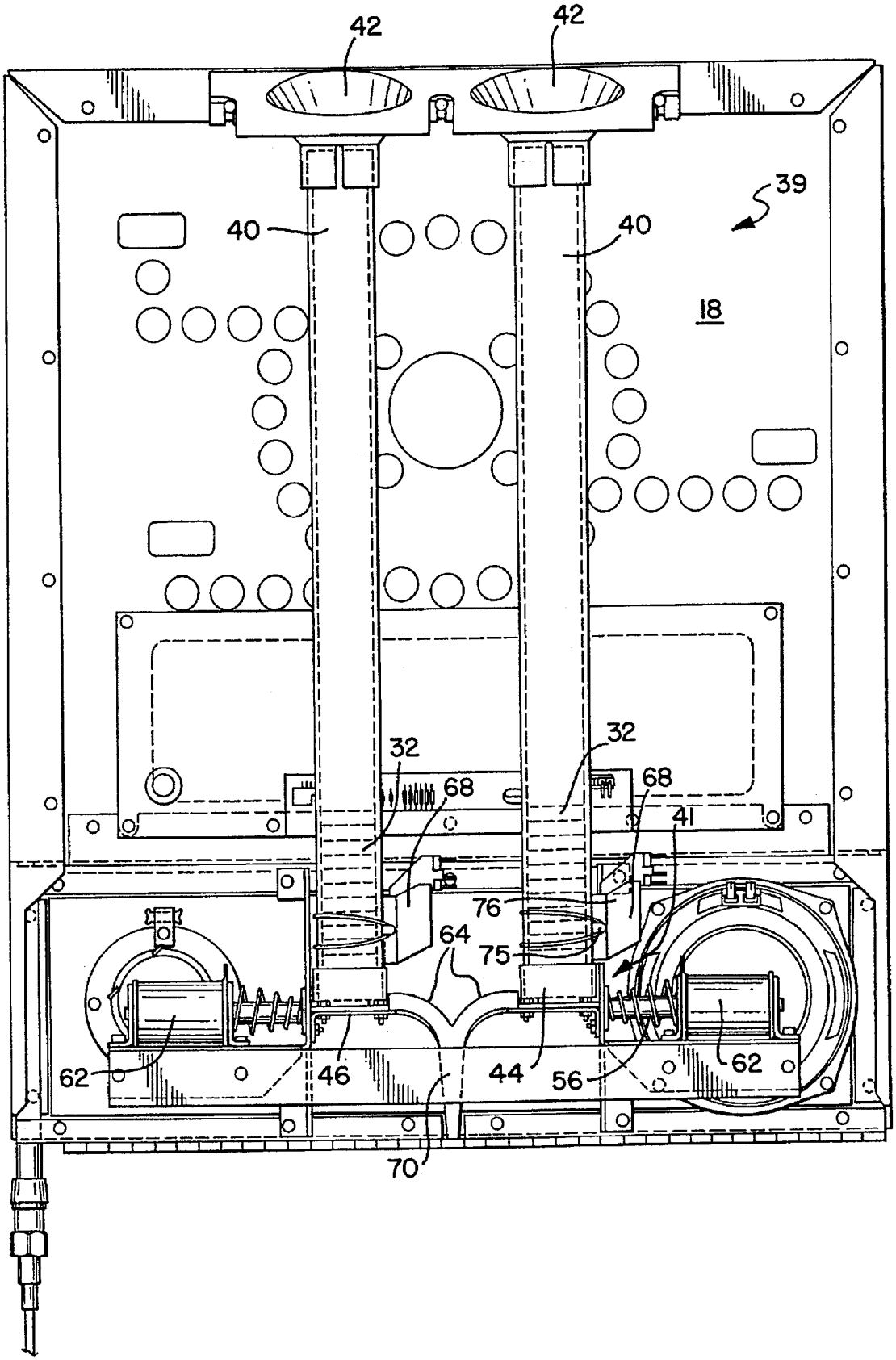
FIG. 2 is rear view of a token dispensing mechanism according to a preferred embodiment of the invention.

FIG. 2 illustrates a mechanism 39 for storing and dispensing game tokens in accordance with a preferred embodiment of the invention. Secured behind display panel 18 are a pair of token reservoirs 40 which contain a supply of stacked game tokens 32. Token reservoirs 40 are preferably plastic tubes having an inside diameter which is slightly larger than the diameter of tokens 32. Provided at the upper end of each reservoir 40 is a conical receptacle 42 which facilitates quick loading of game tokens into the reservoirs, i.e. from a hopper or bucket carried by an operator.

Figure 3:
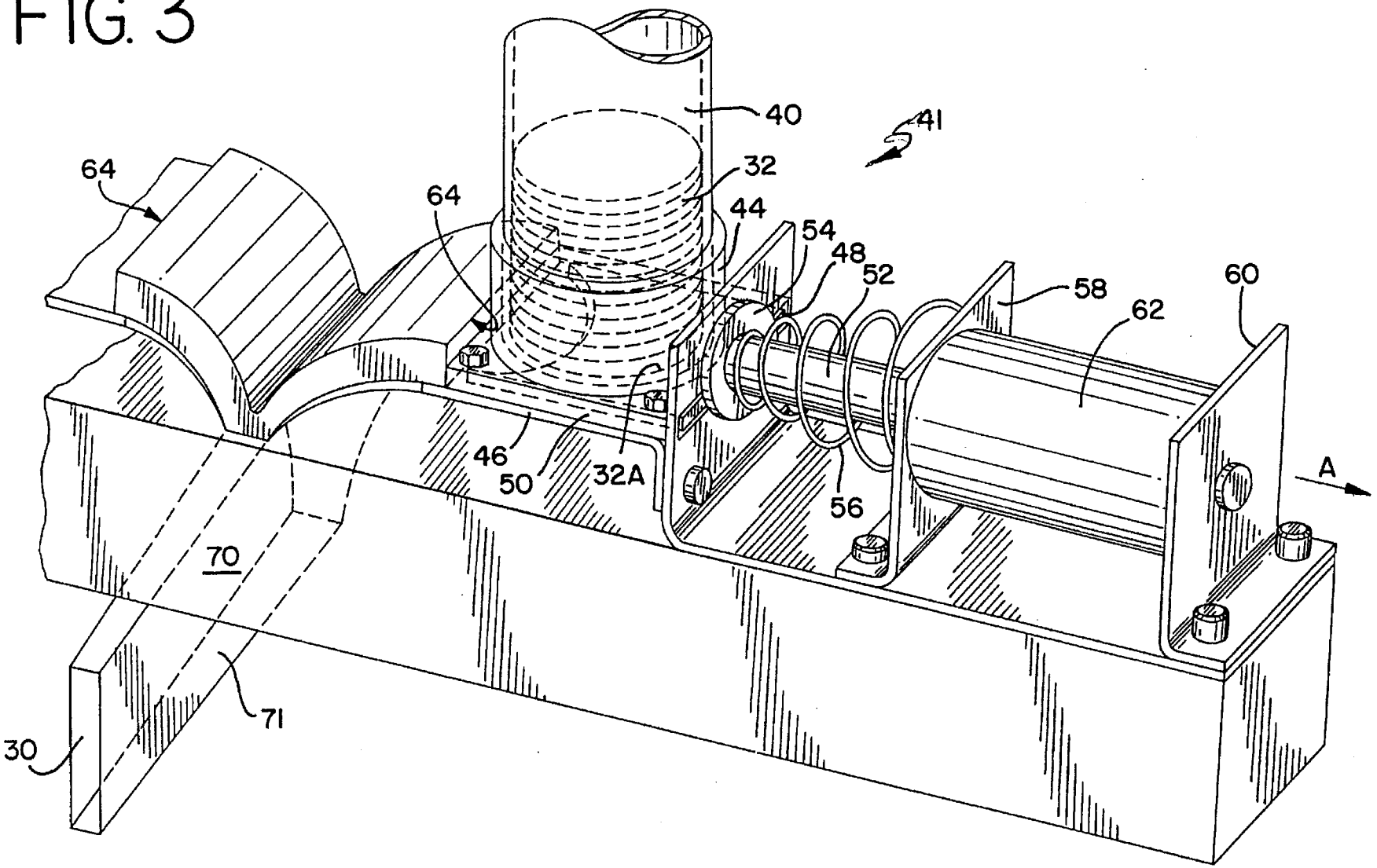
FIG. 3A is a perspective view which illustrate operation of a token dispensing mechanism, according to a preferred embodiment of the invention.

At the base of each reservoir 40, there is provided a token ejecting assembly 41 (FIG. 3). Ejecting assembly 41 is similar in structure to a mechanism provided by Coin Controls Ltd. of Great Britain and described in British Patent No. 1,039,029. Each ejecting assembly 41 includes a flanged base member 44 which surrounds the bottom portion of each reservoir 40 and secures the base of the reservoir 40 to mounting bracket 46. Mounting bracket 46 is affixed to display panel 16 using conventional fastening elements. Base member 44 is provided with a generally rectangular channel 48 which slidably receives a generally planar token projecting member 50 therein. Projecting member 50 is attached to solenoid plunger 52 using a threaded fastener (not shown) which may be formed as an integral part of projecting member 50 and threaded into a hole in the end of plunger 52. Flange 54 is provided on projecting member 50 to limit travel of projecting member 50 within channel 48 and to provide a retaining surface for return spring 56. Spring 56 is retained at an opposite end by solenoid mounting plate 58 which, together with mounting plate 60, secure solenoid 62 to mounting bracket 46. Only one token ejecting assembly is illustrated in FIG. 3. It is to be understood that an identical assembly is provided on the opposite side of token chute 70, for the other column of tokens.

Token chute 70 is provided as a bifurcated member which includes an elongate central token rolling channel 71 and two curved token input channels 64 disposed on either side thereof. Token input channels 64 communicate with rolling channel 71 which terminates at delivery slot 30. Chute 70 is configured to provide smooth travel of the tokens from a horizontal to vertical position as the tokens move from input channels 64 to delivery slot 30. Input channels 64 are aligned with respective token projecting members 50 to provide for delivery of tokens from reservoirs 40 into chute 70.

Level sensors 68 (FIG. 2) are provided to sense the level of tokens in reservoirs 40 in order to alert operators that the token supply is low, or to ensure token dispensing occurs evenly from both reservoirs. Sensors 68 may comprise optical detectors which project a light beam through the transparent reservoirs 40. Elastic elements 69 secure sensors 68 to reservoirs 40 by stretching around the outer circumference of reservoirs 40 and engaging hook elements 75 formed on housings 76.

Energization of solenoid 62 results in the retraction of projecting member 50 from channel 48 as solenoid plunger 52 is retracted in the direction of arrow A, against the bias of return spring 56. Projecting member 50 thus slides out from under token 32A, which is lowermost in reservoir 40. Projecting member 50 is provided with a pusher recess 68 shaped to engage the outer circumference of token 32.

Upon deenergization of solenoid 62, plunger 52 travels in a direction opposite arrow A under force from spring 56 to cause projecting member 50 to return to its original position, thereby projecting token 32A into channel 64. Token 32A travels through curved input channel 64 and falls into central channel 70. The token thereby changes its orientation from horizontal to vertical. Gravitational forces roll token 32 through rolling channel 70. Token 32 then exits delivery slot 30 and is projected on to the inclined surface 14 (FIG. 1 ).

Figure 4:
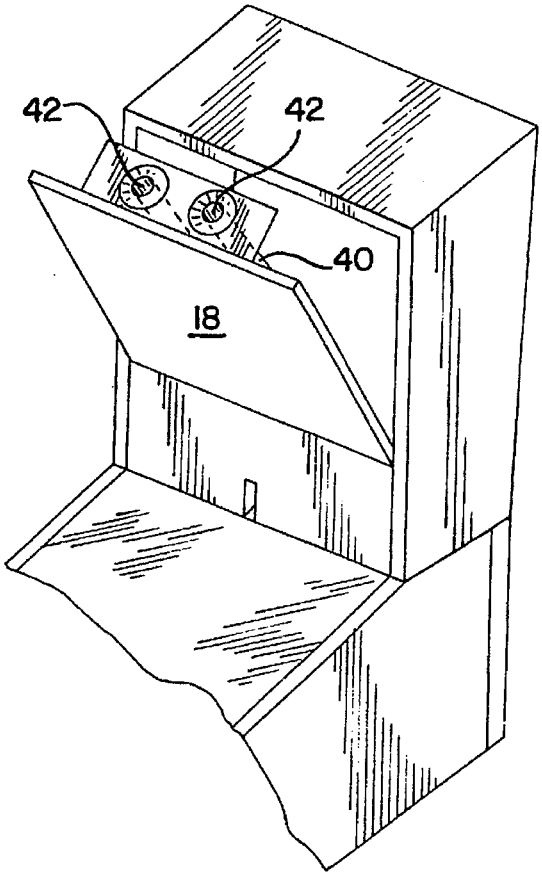
FIG. 4 is a perspective illustrating refilling of a token dispensing mechanism according to a preferred embodiment of the invention.

Referring to FIG. 4, reservoirs 40 may be refilled with game tokens by pivoting channel 18 to the position shown. Channel 18 is secured within back box 16 using conventional hardware which permits pivotal movement and locking of channel 18 in its upright position to prevent unauthorized tampering. Token receptacles 42 facilitate loading of game tokens 32 into the tube shaped reservoirs 40.

Figure 5:
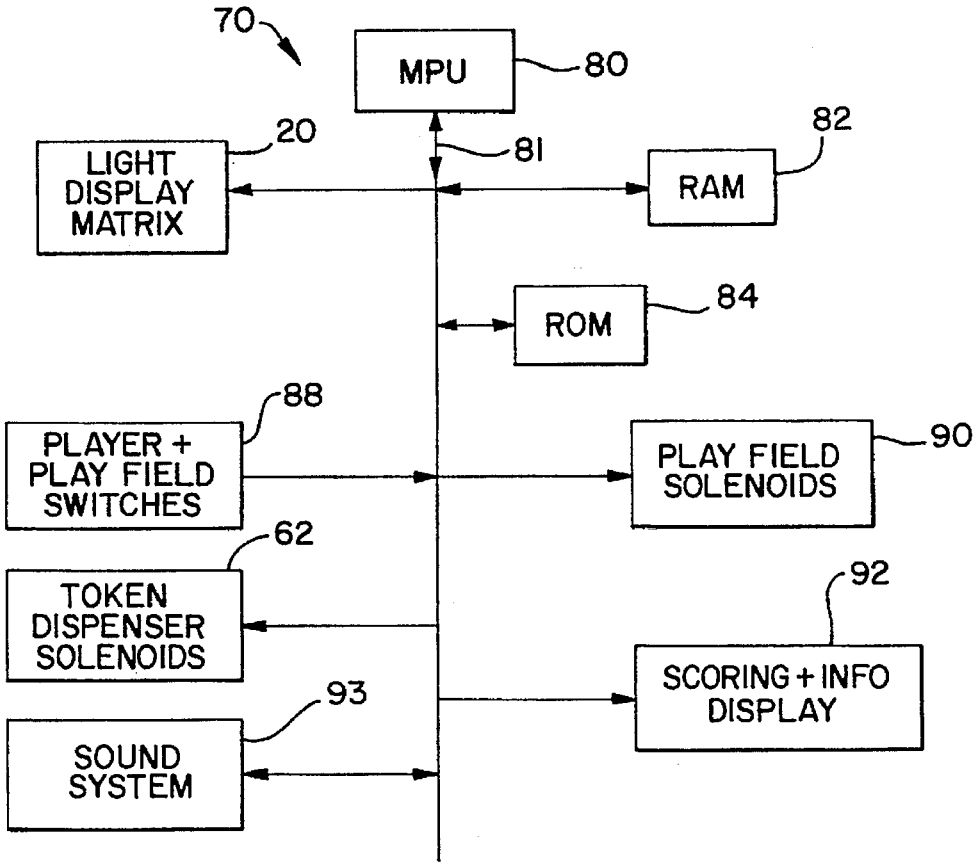
FIG. 5 is a block diagram illustrating a game control apparatus suitable for a token dispensing mechanism according to a preferred embodiment of the invention.

FIG. 5 represents in block diagram form control hardware 70, suitable for controlling token dispenser 39. As is typical in pinball games, microprocessor unit (MPU) 80 communicates electronically via bus 82 with RAM 82 and ROM 84. MPU 80 controls a number of playfield features, including playfield solenoids 90, scoring information and display 92, game sound system 93, light display matrix 20, and switches (playfield and player controlled) 88. In accordance with the present invention, token dispenser solenoids 62 are connected to bus 81 and also controlled by MPU 80. MPU 80 may be programmed in any conventional programming language to energize solenoids 62 when predetermined conditions occur during the course of the game. Control of solenoids 62 may thus occur as a function of events occurring on the playfield or the actuation of player-controlled switches 88. The control system enables interaction between token dispenser 39 and the other elements controlled by MPU 80. For example, display 92 may be provided with a graphical image, such as a human hand whose motion coincides with and suggests token delivery.

In accordance with the present invention, tokens 32 may be used by players at a later time in order to obtain free games, or to activate special game features. This is accomplished by depositing token 32 into token slot 28 (FIG. 1 ) which communicates with known hardware for recognizing valid game tokens. Alternatively, token recognition hardware may be incorporated into coin slot 26 thereby eliminating the need for a separate token slot 32. The token recognition hardware cooperates with MPU 80 such that game play may proceed in accordance with the particular reward predetermined to be activated by token redemption. Those of ordinary skill in the art will recognize that many different types of game rewards may be implemented by programming MPU 80. Examples of such rewards include free games, points added at the beginning of a game, or special play features which require tokens before they are activated. As an additional feature, the token dispenser may be controlled to dispense multiple tokens in rapid succession in order to simulate a "jackpot" after accomplishment of a particularly difficult game objective. In this respect, the dual reservoirs 40 and bifurcated chute 70 offer the advantage of permitting quick successive dispensing of individual tokens, as well as increased storage capacity.

There has thus been disclosed a new and useful device which provides enhanced delivery of tangible game rewards and thereby improves the appeal of amusement devices including rolling ball games. It is to be understood that the preceding description is intended to illustrate a preferred embodiment of the present invention and is not intended to limit the scope of protection, which is set forth in the appended claims.

What is claimed is:

1. In an amusement game housed within a game cabinet having an inclined, transparent viewing surface for permitting a player to view the game and a game control system, the improvement comprising;

a) a plurality of tokens stored in the cabinet for providing a tangible reward to game players for achievement of predetermined game objectives;

b) means, responsive to said game control system, for dispensing the tokens from the cabinet onto said viewing surface such that the tokens move along the viewing surface toward the player.

2. The amusement device of claim 1, wherein the means for dispensing comprises means for rolling the tokens onto said inclined transparent surface toward the player.

3. The amusement device of claim 1, wherein the means for dispensing comprises:

a) means for storing tokens;

b) a token delivery chute for delivering the tokens from the means for storing to the transparent surface; and c) means for ejecting tokens from the means for storing into the chute responsive to the game control system.

4. The amusement device of claim 3, wherein the chute further comprises at least one token input channel for receiving tokens from the means for storing.

5. The amusement device of claim 4, wherein the token input channel is arranged to receive tokens which are oriented in a substantially horizontal plane and wherein the chute is configured to reorient the tokens to a substantially vertical plane after the tokens enter the input channel.

6. The amusement device of claim 3, wherein the means for storing comprises a pair of upright storage tubes for retaining the tokens in a vertical stack.

7. The amusement device of claim 3, further comprising means for sensing the supply of tokens in the means for storing.

8. The amusement device of claim 7, wherein the means for storing comprises transparent tubes and wherein the means for sensing comprises photoelectric sensors disposed proximate said transparent tubes to detect the level of stacked tokens therein.

9. An amusement game comprising:

a) a game cabinet housing an inclined playfield for supporting a rolling ball thereon, an inclined transparent surface window for viewing the playfield and a game control system;

b) a plurality of tokens associated with the game for providing a tangible game reward to a player;

c) means for dispensing the tokens from the cabinet;

d) token receiving means for permitting a player to input tokens into the game cabinet;

e) said game control systems operating said means for dispensing when game objectives are achieved and including means for activating predetermined game features in response to insertion of tokens into the token receiving means.

* * * * *